United States Patent [19]

Weidhaas

[11] Patent Number: 4,830,592

[45] Date of Patent: May 16, 1989

[54] ROTARY GEAR PUMP OR MOTOR FOR FLUIDS

[75] Inventor: Horst Weidhaas, Hof, Fed. Rep. of Germany

[73] Assignee: Vickers Systems GmbH, Bad Homburg, Fed. Rep. of Germany

[21] Appl. No.: 182,371

[22] Filed: Apr. 18, 1988

[30] Foreign Application Priority Data

Apr. 24, 1987 [EP] European Pat. Off. ..... 87106040.6

[51] Int. Cl.[4] ..... F04C 2/08; F04C 15/00

[52] U.S. Cl. ..... 418/132

[58] Field of Search ..... 418/131, 132

[56] References Cited

U.S. PATENT DOCUMENTS

| | | | |
|---|---|---|---|
| 3,371,615 | 3/1968 | Pettyjohn et al. | 418/132 |
| 4,242,066 | 12/1980 | Hodgson | 418/132 |
| 4,358,260 | 11/1982 | Joyner | 418/132 |
| 4,465,444 | 8/1984 | Dworak et al. | 418/132 |
| 4,527,966 | 7/1985 | Laumont | 418/132 |
| 4,606,713 | 8/1986 | Lipscombe | 418/132 X |

FOREIGN PATENT DOCUMENTS

| | | |
|---|---|---|
| 211723 | 2/1987 | . |
| 2403319 | 7/1975 | Fed. Rep. of Germany . |
| 1216737 | 11/1959 | France . |
| 1210824 | 11/1970 | United Kingdom . |
| 2028925 | 3/1980 | United Kingdom . |

*Primary Examiner*—Michael Koczo

*Attorney, Agent, or Firm*—Barnes, Kisselle, Raisch, Choate, Whittemore & Hulbert

[57] ABSTRACT

A gear pump or motor comprises a pair of rotary gears which are in external meshing engagement with each other. A thrust plate is pressed against the side faces of the gears by means of a plurality of pressure areas which are produced by means of a sealing and compensating unit. The unit is urged piston-like by virtue of fluid pressure chambers against the back of the thrust plate to engage it against the gears. Depending on the direction of rotation of the gears of the machine the pressure areas define the general configuration of a 3 or a ϵ.

9 Claims, 3 Drawing Sheets

ROTARY GEAR PUMP OR MOTOR FOR FLUIDS

BACKGROUND OF THE INVENTION

The present invention relates generally to a gear pump or a gear motor for a fluid. For the sake of brevity in the specification, the expression rotary gear machine for fluid actuation will be used broadly to cover both a rotary gear pump and a rotary gear motor; in the case of the gear pump, the pump provides for actuation of the fluid, that is to say displacement thereof, while in the case of the motor, the motor is actuated by the fluid.

An example of such a rotary gear machine for fluid actuation may be found in specification FR-A-No. 1 442 211, and comprises a housing having a high pressure port and a low pressure port, together with first and second pressure or thrust plates disposed at respective sides of a pair of meshing gears. The gears are carried on respective shaft portions of which at least one extends outwardly to provide a drive input or output shaft. One side of one of the thrust plates adjoins an intermediate plate while with its other side it bears against the side surfaces of the meshing gears. The intermediate plate is of a generally 8-shaped configuration, co-operating with sealing means to define a plurality of pressure areas for pressing the thrust plate against the side surfaces of the gears in a specifically selected fashion for enhanced operational efficiency of the unit.

In that arrangement, the thrust plates are at the same time in the form of mounting carriers and are of a configuration corresponding to that of a '8', although with the 'necked' configuration thereof being somewhat attenuated in order not to be excessively narrow in the central portion of the 8-shaped configuration. The contour of the intermediate plate corresponds to that of the thrust plates which form the carriers. Provided in a lateral housing portion is a groove for accommodating a seal which is also of a generally 8-shaped configuration, the peripheral contour thereof being generally smaller than that of the thrust plate, although the seal has outwardly extending projections forming ears thereon, which extend to a position beyond the peripheral configuration of the intermediate plate in order to delimit the various pressure areas thereon. More specifically, the pressure areas comprise a central high-pressure area which extends not only axially laterally from the location of external engagement as between the teeth of the gears, but also in an annular configuration around the mounting shaft portions so that generally that pressure area is similar to the configuration of a pair of spectacles. Other pressure areas are arranged outside the outside contour of the seal, insofar as the intermediate plate projects therebeyond. The high pressure areas in the construction further include a high-pressure area which extends in an arc parallel to the tips of the teeth of one gear, part of the way around that gear, and another similar high-pressure area which also extends in an arc parallel to the tips of the teeth of the other gear, part of the way around that other gear. Those two high-pressure areas are combined together as effectively a single area. The actuation surface of the intermediate plate is fairly large and that means that the pressure areas are similarly of substantial extent. That may be a factor of some disadvantage when using high system pressures. Moreover, the system pressure passes through gaps on the rear side of the intermediate plate, such gaps being formed as a result of flexing of the components of the mechanism, under load due to the high pressure. The pressing action of the mechanism therefore is operative only when the difference between the pressures at the inlet and the outlet of the unit exceeds a given level so that due to deformation and displacement of components, the high pressure can reach the locations at which it is required to act.

In another rotary gear machine for fluid actuation, as disclosed in German patent specification No. 1 653 866, the mechanism has a pressure or thrust plate which in the region of its intake and its outlet has a respective peripherally extending seal at the rear side thereof, thereby forming a high-pressure area for urging the thrust plate towards the meshing gears. As pressurised fluid is also to be found in the region between the pressure or thrust plate and the gears, the effect of that pressure area which is disposed in the region of the pressure connection port is slight. In order to provide for an adequate level of contact pressure in that arrangement, the system pressure, which is at a high pressure level, is taken from a gap between the two meshing gears and passed to the rear of the thrust plate by way of communicating passages in the form of grooves. That arrangement therefore makes use of the fact that the gears only have a gap between them at the high-pressure side whereas at the low-pressure side they block off any possible flow of fluid. A disadvantage in that configuration is the fact that the differential pressure as between the inlet and the outlet must exceed a certain level so that the above-indicated phenomenon of a gap between the meshing gears occurs. For example, when operating the machine as a gear motor, it may happen that an increased pressure occurs in the return so that the difference relative to the pressure in the feed is low. In such a case the thrust plates are not adequately pressed against the gears and the result is an extremely high level of external leakage oil.

SUMMARY OF THE INVENTION

An object of the present invention is to provide a rotary gear machine for fluid actuation, which ensures satisfactory operation in both directions of rotation thereof.

Another object of the present invention is to provide a rotary gear pump or motor for a fluid, having a thrust plate which is urged against the meshing gears with the appropriate contact pressure, thereby to provide for a correct axial compensation effect.

Yet another object of the present invention is to provide a gear pump or motor for a fluid, which is less sensitive to fluctuations in the relative pressures in the various parts of the arrangement.

Still a further object of the present invention is to provide a rotary gear machine which affords a higher level of operating efficiency by virtue of a reduced level of fluid leakage.

In accordance with the teachings of the present invention, those and other objects are achieved by a rotary gear mechanism for fluid actuation, comprising a housing defined by a central housing portion and first and second lateral housing portions, with a high-pressure connection port and a low-pressure connection port. The housing includes at least a first thrust plate and preferably first and second thrust plates, and a pair of gears which are mounted rotatably within the housing, in external meshing engagement with each other, being carried on mounting shaft portions of which at least one extends outwardly of the housing to provide a drive input or output, depending on whether the machine operates as a pump or a motor. One face of the thrust plate adjoins an intermediate plate while the other face bears against the side surfaces of the meshing gears of the pair. The intermediate plate is of a generally 8-shaped configuration, co-operating with sealing means to define a plurality of pressure areas, namely: a first central high-pressure area extending axially laterally from the location at which the gears are in meshing engagement with each other; a second outer high-pressure area which extends in a generally arcuate configuration and substantially parallel to the tips of the teeth of one gear, at a position remote from the location of meshing engagement between the gears; a third outer high-pressure area which extends in a generally arcuate configuration and parallel to the tips of the teeth of the other gear and which is disposed symmetrically with respect to the second high-pressure area, relative to the location of meshing engagement between the gears; a fourth high-pressure area extending in an arcuate configuration substantially parallel to the tips of the teeth of the one gear, between the first and second high-pressure areas; and a fifth high-pressure area extending in an arcuate configuration and substantially parallel to the tips of the teeth of the other gear, between the first and third high-pressure areas. The intermediate plate and the sealing means are structurally combined to provide a sealing and compensating unit and are disposed in a generally 8-shaped groove, thereby defining first, second, third, fourth, fifth, sixth and seventh chambers of which the first through fifth chambers are acted upon by high fluid pressure to provide the first through fifth high-pressure areas, while the first high-pressure area also covers over the two acutely converging generally wedge-shaped regions between the meshing gears and extends to a location between the fourth high-pressure area and the fifth high-pressure area.

It will be seen therefore that the configuration in accordance with the principles of the invention provides first through fifth pressure areas of suitable sizes, which are provided by respective chambers which are subjected to fluid pressure and which act on the rear of the thrust plate or plates. The chambers are disposed in a groove in the general configuration of a '8' and in a sealing and compensation unit disposed therein. The pressing force produced in that way is such that the gap or clearance between the thrust plate and the co-operating surfaces of the gears is reduced to an amount as is necessary for satisfactory lubrication and cooling, without incurring excessively high levels of fluid leakage, under the wide range of operating conditions which may occur in a gear pump or gear motor. More specifically, the arrangement in accordance with the invention thus provides three pressure areas which are independent of the direction of rotation of the gears, namely in the vicinity of the location of engagement of the gears, being the first high-pressure area referred to above, together with the second and third high-pressure areas which extend partly around the tips of the teeth of the respective gears, remote from the location of meshing engagement of the gears. The other two pressure areas are dependent on direction of rotation, that is to say when the adjacent fluid connecting port is at system pressure, a high-pressure area is formed while if the adjacent fluid connecting port is at low pressure, the corresponding areas do not constitute high-pressure areas. It will be appreciated that in each case a respective fluid connecting port is supplied with system pressure so that in any situation two of the four areas which may fluctuate between high and low pressures constitute high-pressure areas.

As indicated above, the high-pressure areas are delimited by sealing means which are arranged in the configuration of a '8' and extend in a corresponding groove in the housing or thrust plate. Preferably, the groove is of two different depths, the greater depth being provided for the pressure areas which are independent of the direction of rotation and the shallower depth being provided for the other pressure areas which are dependent on the direction of rotation. The feed and discharge of fluid is effected by way of connecting ports which are disposed in the two generally wedge-shaped regions defined at respective sides of the 8-shape. The sealing action in respect of the first pressure area which is disposed between the mounting spindle portions of the gears in the region in which the gears are in meshing engagement with each other blocks off the direct path of fluid flow between the high-pressure connecting port and the low-pressure connecting port; while the indirect path of flow around the mounting spindle portions, in the clearance between a respective gear and the thrust plate, is closed off by the sealing effect in respect of the respective outer high-pressure area. For that purpose the sealing means has horn-like projections which extend radially away from the mounting spindle portions and which are thus disposed transversely in the gap between the tips of the teeth and the thrust plate. It will be appreciated that the fluid-barrier effect is not an absolute one so that a film of lubricant is maintained, as is required for satisfactory operation of the machine.

The sealing and compensating unit together with the generally 8-shaped groove respresents a hydraulic cylinder which is operative between the thrust plate and the side portion of the housing, being referred to herein as a pressure area. The height of the chambers which are subjected to fluid pressure differs in regard to the pressure areas which are respectively dependent on and independent of the direction of rotation of the gears. There are therefore two pressure levels or pressure planes. Those different pressure levels make it possible to use sealing lips on the seals, which act as check valve means.

Further objects, features and advantages of the invention will be apparent from the following description of preferred embodiments thereof.

DESCRIPTION OF PREFERRED EMBODIMENTS

Figure 1:
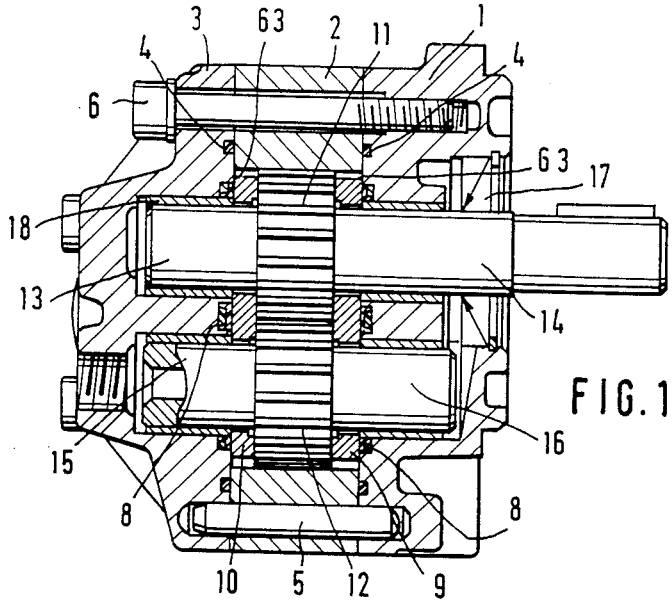
FIG. 1 is a view in axial longitudinal section through a gear pump or motor.

Reference is first made to FIG. 1 showing a rotary gear machine for fluid actuation, which can thus be operated as a pump or a motor. The machine comprises a housing which includes three housing portions, namely a central housing portion 2 and first and second lateral housing portions 1 and 3 which are in the form of mounting housing portions acting as cover portions on respective sides of the central housing portion 2. The lateral housing portions 1 and 3 each have a peripherally closed groove 4 therein, in the face thereof towards the central housing portion 2, with each groove 4 carrying a suitable sealing means. The housing portions 1 and 3 are held together or pressed together in their correct positions relative to each other by pins 5 and bolts 6 so that the interior of the housing can withstand the necessary pressure which may be for example 250 bars.

Figure 3:
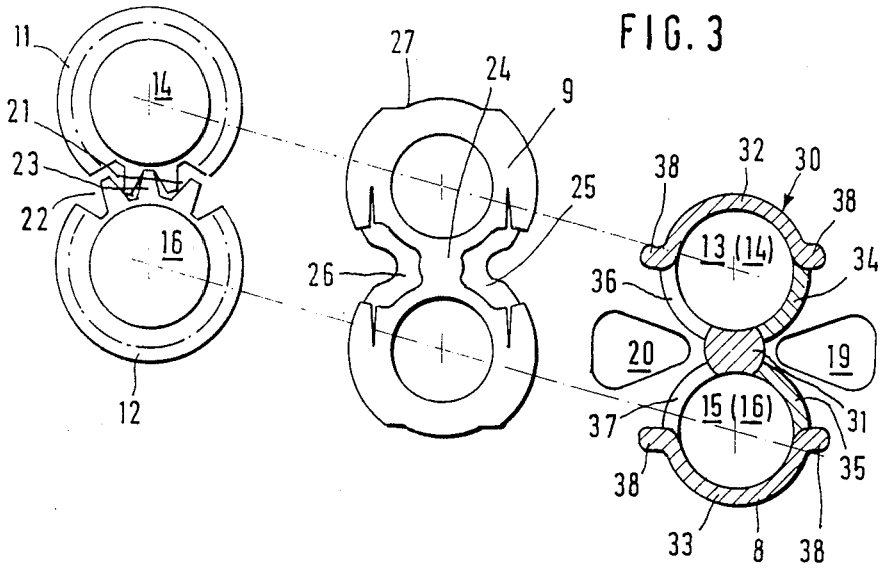
FIG. 3 is an exploded view of parts of the housing of the gear pump in accordance with the invention, with inlet and outlet openings and pressure areas in the form of a '3', a thrust plate and a meshing pair of gears.
Figure 4:
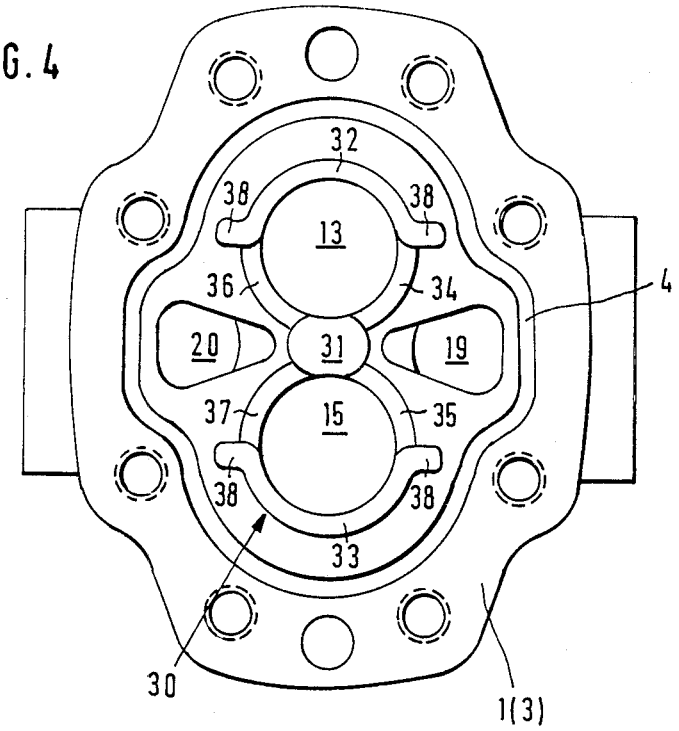
FIG. 4 is a view on an enlarged scale of the housing portion shown in FIG. 3.

In the region of the interior of the housing, the lateral housing portions 1 and 3 each have a respective groove as indicated at 8. Each groove 8 is in the general configuration of a '8' and accommodates respective sealing means which serve to provide for high-pressure areas, as will be described in greater detail hereinafter. The high-pressure areas are disposed at the rear of thrust plates 9 and 10 which are disposed on respective sides of the meshing gears 11 and 12 and which bear against the respective side surfaces thereof. The gears 11 and 12 are carried by mounting spindle portions 13 through 16, wherein the mounting spindle portion 14 is also extended outwardly of the housing to serve as an input or output shaft for the mechanism. The spindle portion 14 is sealed relative to the housing by a suitable seal as indicated at 17. The spindle portions 13 through 16 are mounted in mounting bushes 18 in the lateral housing portions 1 and 3. The housing portion 1 or 3 also has ducts for the feed and discharge of the fluid, which are shown in FIGS. 3 and 4 in the form of a feed opening or port 19 and a discharge opening or port 20. The feed and discharge ducts also pass through the respectively adjacent thrust plate 9 or 10 in the region of generally wedge-shaped areas or regions which are indicated by references 21 and 22 in FIG. 3, between the mutually meshing gears 11 and 12, the location of meshing thereof being identified by reference numeral 23 in FIG. 3. The meshing location 23 is axially laterally sealed off by the thrust plates 9 and 10 which for that purpose provide a sealing web portion identified by reference numeral 24 in FIG. 3. Extending laterally of the web portion 24 are trapezoidal recesses or cut-outs 25 and 26 which communicate the feed and discharge ports 19 and 20 with regions 21 and 22.

Referring still to FIG. 3, the groove 8 is covered by a piston-like sealing and compensating unit which is indicated generally at 30 in FIG. 3. Formed between the floor of the groove 8 and the unit 30 are seven chambers identified at 41 through 47 in FIG. 5, while formed on the other, smooth or flat side of the unit 30 are associated possible pressure areas 31 through 37 as shown in FIGS. 3 and 4. If pressure fluid passes into the above-indicated chambers, the unit 30 is displaced in a piston-like fashion and is pressed with its smooth side as shown in FIGS. 3 and 4 against the thrust plates 9 or 10 respectively. It will be appreciated that the boundary lines in respect of the pressure areas 31 through 37 do not actually occur in practice. In FIG. 3, the regions in which the unit produces a pressure effect in one direction of rotation of the machine are shown by hatching as high-pressure areas 31 through 35. The areas 31, 32 and 33 are always high-pressure areas, irrespective of the direction of rotation of the gears 11 and 12 of the machine. The areas indicated at 34 and 35 are high-pressure areas when the adjacent connecting port or opening 19 carries system pressure which is a high pressure, while the areas 36 and 37 constitute high-pressure areas when the adjacent connecting port 20 carries the system pressure while otherwise they may constitute low pressure areas. Depending on which of the ports 19 and 20 carries system pressure, the high-pressure areas are thus defined in such a way as to delimit a '3' or a 'ϵ', that is to say a '3' which has been reversed side-to-side. The areas 34 through 37 are thus dependent on direction of rotation of the meshing gears 11 and 12, in regard to the effect of providing high-pressure areas.

Figure 5:
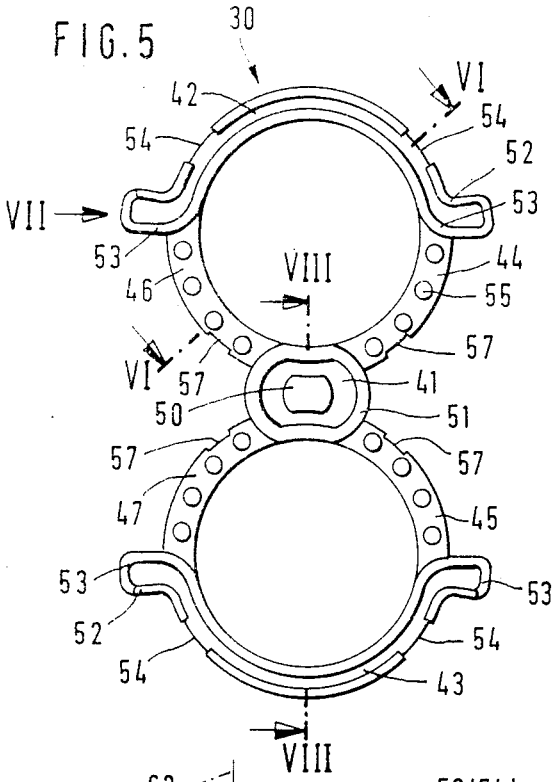
FIG. 5 shows a sealing ring in the form of a '8'.

Referring now to FIG. 5, shown therein is the underside of the sealing and compensating unit 30, that is to say as viewed from the floor of the groove 8. Disposed in the chamber 41 is a raised support portion 50 and the chamber itself is surrounded by a sealing lip as indicated at 51. The chambers 42 and 43 are each bordered by a respective peripherally extending rim portion 52 which adjacent to each of the chambers 44 through 47 can be in the form of a sealing lip as indicated at 53 and which can be interrupted in an outward direction as indicated at 54. In the region of the chambers 44 through 47 the sealing and compensating unit 30 has knobs or projections 55 and lateral bead portions 56 which serve for guiding and sealing the unit in the groove 8. In addition, recesses 57 are provided adjacent the ports indicated at 19 and 20 in for example FIG. 4, so that system pressure can possibly pass into the chambers 44, 45 and 46, 47 respectively.

Figure 6:
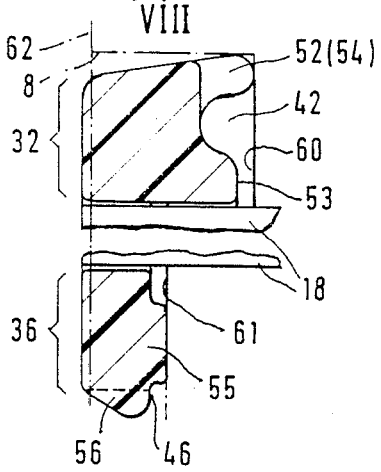
FIG. 6 is a view in longitudinal section through the sealing ring shown in FIG. 5, taken along line VI—VI therein, on an enlarged scale and in partly shortened form.
Figure 7:
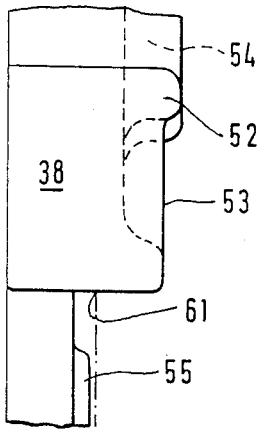
FIG. 7 is a view along arrow VII of the sealing ring shown in FIG. 5, in partly broken-away form and on an enlarged scale.
Figure 8:
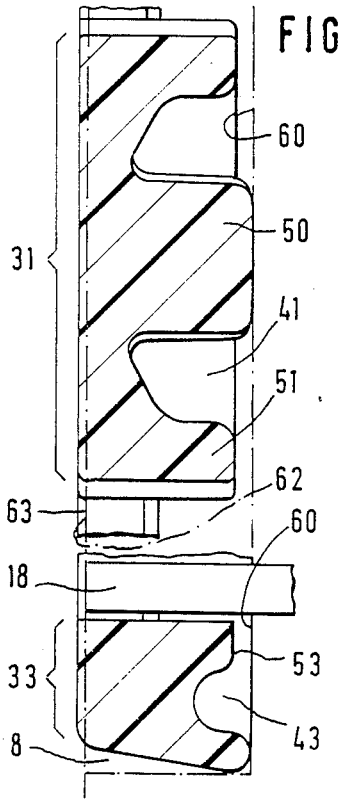
FIG. 8 is a view in section through the sealing ring of FIG. 5, taken along line VIII—VIII therein.

The groove 8 has two depths, as can best be seen from FIGS. 6 through 8. Provided in the region of the areas 31, 32 and 33 is a base plane 60 in respect of the groove 8 while in the region of the areas 34 through 37 the grove has a plane as indicated at 61. The surface of the housing portion 1 or 3 respectively is indicated at 62 in FIG. 6. It will be seen that the sealing and compensating unit 30 projects slightly beyond the surface 62 and in operation of the machine is urged further into the groove 8 by the thrust plate so that as a result of compression of the support portion 50, the rim portions 52 and the projections 55, the sealing and compensating unit 30 is subjected to a spring biasing effect towards the thrust plate, which is in addition to the hydraulic force resulting from the high-pressure areas 31 through 33, and 34 and 35 or 36 and 37.

A certain leakage oil flow flows in the gap or clearance 63 between the housing portion 1 and the thrust plate 9 or the housing portion 3 and the thrust plate 10. The pressure gradient of that leakage oil flow is at its greatest on the direct line between the ports 19 and 20, but it is also still considerable around the mounting spindle portions 14, 16 and 13, 15 respectively. In order to reduce that leakage flow, the sealing and compensating unit 30 has projecting portions as indicated at 38 in FIGS. 3 and 4, extending outwardly like ears on respective sides of the unit 30, as can be clearly seen for example from FIGS. 3 and 4, thereby forming the ends of the pressure areas 32 and 33. The projecting portions 38 form a certain obstacle to the flow of fluid around the spindle portions 13, 15 and 14, 16 respectively.

At its outer edge, remote from the gear meshing location 23 or the location of the web portion 24, each thrust plate 9 or 10 has a respective recess as indicated at 27 for example in FIG. 3. The recesses 27 communicate with the gaps between the teeth of the gears 11 and 12 and therefore can provide for interchange of fluid. The pressure fluid can thus pass by way of the gaps indicated at 54 in FIGS. 6 and 7, into the respective chambers 42 and 43. As the sealing lips 53 are only in contact with the groove surface 60 but are not in a clamped condition therein, they can deflect inwardly into the respective chamber 42 or 43 when a higher pressure is applied from the adjacent chamber 44 or 45 (in the case of the arrangement being put under high pressure by way of the port 19) or by way of the chambers 46 and 47 (in the event of the arrangement being put under high pressure by way of the port 20). The chambers 42 and 43 can therefore also be filled from the respective adjacent chamber 44, 45 or 46, 47.

The inner chamber 41 is filled in the above-indicated manner from the adjacent chambers 44 and 45 (in the event of the arrangement being subjected to high pressure through the port 19) or by way of the chambers 46 and 47 (in the event of the arrangement being put under high pressure through the port 20). The sealing lip 51 may deflect into the chamber 41 when a higher pressure is applied from the outside so that the internal pressure is built up until system pressure is reached, whereupon the sealing lip 51 moves back into its original position.

The sealing lips 51 and 53 bear against the wall of the groove which may also be formed by the outer edge of the bush 18. Accordingly there is no possibility of deflection of the sealing lip 51 or 53 in an outward direction. The sealing lip 52 or 53 therefore acts like a check valve which permits a flow of fluid only in one direction.

The high-pressure areas which are operative and disposed in the configuration of a '3' or a 'ϵ' correspond to the variation in pressure in respect of the leakage oil flow between the thrust plate and the lateral housing portion, but a region of somewhat larger area is involved so that overall the sealing and compensating unit 30 penetrates into the above-mentioned gap, with its top side as shown in FIGS. 3 and 4. Finally, an equilibrium in respect of the forces involved is reached in the gap 63 which is reduced as a result of the movement of the unit 30, with the definitive and final width of the gap being appropriate for all respective operating conditions of the machine. The pressure force applied by the arrangement is never so high that the leakage oil flow which is required to provide a film of lubricant is completely suppressed, on the one hand, while on the other hand the gap or clearance 63 is sufficently small to prevent undesirable leakage oil losses.

The groove 8 does not have to be provided in the respective lateral housing portions 1 or 3 as it is also possible for the groove 8 to be provided in the respective thrust plate. That construction may be envisaged in particular when employing the structure shown in FIG. 2 which uses sleeves or bushes 28 and 29 as the thrust plates. In that case the sealing and compensating unit 30 extends beyond two adjacent sleeves or bushes 28 and 29 respectively, which are of a flattened configuration at their location of mutual contact, in order jointly to present at their ends a surface configuration corresponding to that indicated at 24 in FIG. 3.

Figure 2:
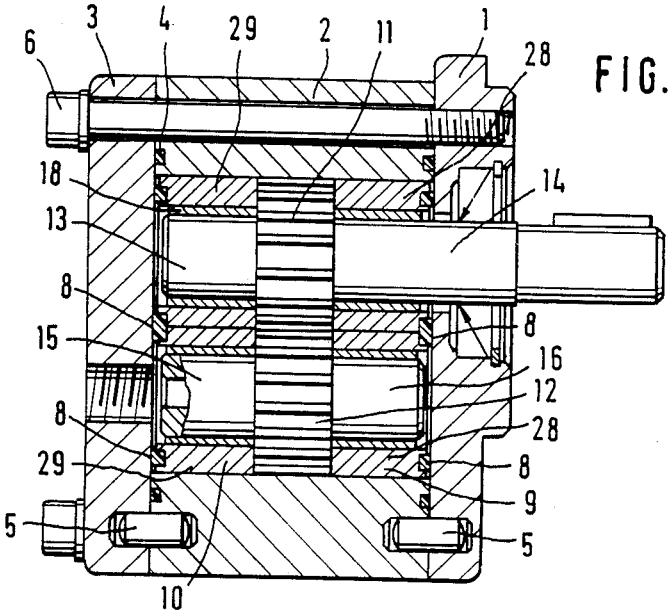
FIG. 2 shows a modified embodiment of a gear pump or motor.

In other respects the FIG. 2 structure generally corresponds to that described in greater detail hereinbefore with reference to FIG. 1, to which reference may therefore be approriately made.

The sealing and compensating unit 30 has been described and illustrated in the form of an integral body but it will be appreciated that the unit 30 may be made up of different components, for example a support body and a sealing body, or a plurality of individual sealing elements may be mounted on the support body. Thus for example it would be possible for the sealing lips and the sealing web portions to comprise individual shaped components.

Any suitable material may be considered for the sealing and compensating unit 30, preferably for example polyurethane of quality U 28, as is used for O-rings under extreme conditions of use (for example PDF-Ultrathan from Parker-Prädifa).

It will be appreciated that the foregoing constructions have been described solely by way of example and illustration of the teachings of the present invention and that various modifications and alterations may be made therein without thereby departing from the spirit and scope thereof.

What is claimed is:

1. A rotary gear machine comprising a housing, said housing having a high-pressure port and a low-pressure port and including a central housing portion and a first and a second lateral housing portions, a first gear and a second gear meshing with one another, a first mounting shaft portion fixed to said first gear and a second mounting shaft portion fixed to said second gear, said mounting shaft portions being journalled in said housing, at least one of said shaft portions extending outwardly of said housing, said gears having first and second side surfaces, thrust plates means including at least one thrust plate having a first face and a second face, said first face of said at least one thrust plate engaging said first side surfaces of said gears, a sealing and compensating unit of a generally 8-shaped configuration, a generally 8-shaped groove arranged between said thrust plate means and at least one of said first and second lateral housing portions, said sealing and compensating unit being housed in said generally 8-shaped groove and engaging said second surface of said at least one thrust plate, said generally 8-shaped groove having at least sections of a first, greater depth and sections of a second smaller depth, said sealing and compensating unit having wall means to define, together with said generally 8-shaped groove, seven chambers, namely a first central high-pressure chamber extending axially laterally from the location of meshing engagement of the gears, a second outer high-pressure chamber extending in an arcuate configuration in parallel relationship with the tips of the teeth of said first gear, at a position remote from the location of meshing engagement of said gears, a third outer high-pressure chamber which is disposed in parallel relationship with the tips of the teeth of said second gear and which is arranged symmetrically with respect to the second high-pressure chamber relative to said location of meshing engagement of said gears, a fourth high-pressure chamber which extends in an arcuate configuration in parallel relationship with the tips of the teeth of said first gear between said first and second high-pressure chambers, a fifth high-pressure chamber which extends in an arcuate configuration in parallel relationship with the tips of the teeth of said second gear between said first and third high-pressure chambers, a sixth low-pressure chamber which extends in an arcuate configuration symmetrically to said fourth high-pressure chamber in parallel relationship between the tips of the teeth of said first gear between said first and second high-pressure chambers, and a seventh low-pressure chamber which extends in an arcuate configuration symmetrically to said fifth high-pressure chamber in parallel relationship to the tips of the teeth of said second gear between said first and third high-pressure chambers, said first, second and third high-pressure chambers being arranged in said groove sections of greater depth, said fourth, fifth, sixth and seventh chambers being arranged in said groove sections of smaller depth, said wall means of said sealing and compensating unit being arranged so that fluid pressure in said first, second and third chambers is sealed off from said adjacent sixth and seventh chambers.

2. The rotary gear machine set forth in claim 1, wherein said sealing and compensating unit has wall means which bear against said wall of said groove section of said greater depth.

3. The rotary gear machine set forth in claim 1, wherein said sealing and compensating unit has lateral bead means which are engaged by said walls of said groove sections of smaller depth, said lateral bead means having recesses which respectively are arranged in said fourth and fifth chambers adjacent to said first port and in said sixth and seventh chambers adjacent to said second port.

4. The rotary gear machine set forth in claim 1, wherein said sealing and compensating unit has rim portions bordering said first, second and third chambers.

5. The rotary gear machine set forth in claim 1, wherein said sealing and compensating unit has sealing lips in the region of the inner chamber, said sealing lips being arranged so as to seal off high pressure fluid which is included in said inner chamber and to let pass high pressure fluid which is outside of said inner chamber, into said inner chamber.

6. The rotary gear machine set forth in claim 1, wherein said outer chambers each have a semi-circular configuration as a main portion and ear portions extending radially outwardly from the main portion.

7. The rotary gear machine set forth in claim 1, wherein said sealing and compensating unit is made up of rubber parts for forming sealing rim portions and sealing lips, and parts of synthetics to form a support body.

8. The rotary gear machine set forth in claim 1, wherein said central housing portion has a thickness in axial direction corresponding to the thickness in axial direction of the gears and said thrust plate means.

9. The rotary gear machine set forth in claim 8, wherein said thrust plate means comprises bushes for journalling said mounting shaft portions.

* * * * *